United States Patent [19]

Yandell

[11] 4,058,163

[45] Nov. 15, 1977

[54] SELECTIVELY ACTUATED VIBRATING APPARATUS CONNECTED WITH WELL BORE MEMBER

[76] Inventor: James L. Yandell, 706 Shenandoah Drive, Conroe, Tex. 77302

[21] Appl. No.: 704,075

[22] Filed: July 9, 1976

Related U.S. Application Data

[63] Continuation-in-part of Ser. No. 386,106, Aug. 6, 1973, abandoned.

[51] Int. Cl.[2] ..... E21B 41/00

[52] U.S. Cl. ..... 166/177; 166/178; 166/193; 175/55; 175/107; 175/231; 175/237

[58] Field of Search ..... 166/177, 193, 249, 194, 166/178, 155; 175/55, 107, 231, 246, 237; 259/DIG. 43

[56] References Cited

U.S. PATENT DOCUMENTS

| | | | |
|---|---|---|---|
| 2,187,088 | 1/1940 | Malan | 166/177 X |
| 2,307,983 | 1/1943 | Barnes | 166/194 |
| 2,825,412 | 3/1958 | Standridge | 166/193 |
| 2,967,048 | 1/1961 | Fontaine | 259/DIG. 43 |
| 3,335,801 | 8/1967 | Wilsey | 166/177 |

*Primary Examiner*—Ernest R. Purser
*Assistant Examiner*—William F. Pate, III
*Attorney, Agent, or Firm*—Clarence A. O'Brien; Harvey B. Jacobson

[57] ABSTRACT

A vibrating apparatus connected with a member insertable into a well bore including an insertable and retrievable member enabling the vibrating apparatus to be selectively actuated. The vibrating apparatus includes a rotatable, eccentric weight forming a rotor having selectively closable through passage means and bypass means oriented to impart rotation of the eccentric weight when the through passage is closed and pressurized fluid is required to pass through the bypass for discharge in offset relation to the axis of rotation for rotating the eccentric weight thereby vibrating the apparatus and the well bore member to which it is attached. In one embodiment of the invention, the through passage is closed by a ball valve which can be inserted into the flow passage at ground surface for movement into engagement with a valve seat by gravity together with a magnet insertable into the flow passage for retrieving the ball valve which is subject to magnetic attraction. Another embodiment of the vibrating apparatus includes an insertable plug having a spiral passageway peripherally thereof with the plug being locked to the rotatable eccentric weight when inserted into the flow passage and provided with a passageway communicating with the spiral passageway for guiding fluid pressure therethrough. A third embodiment involves the construction of the vibrating apparatus of drillable material to enable it to be effectively used when running in well casings or the like.

11 Claims, 8 Drawing Figures

SELECTIVELY ACTUATED VIBRATING APPARATUS CONNECTED WITH WELL BORE MEMBER

CROSS REFERENCE TO RELATED APPLICATION

This application is a continuation-in-part of U.S. Ser. No. 386,106, filed Aug. 6, 1973, for VIBRATING APPARATUS, ETC, now abandoned.

BACKGROUND OF THE INVENTION

1. Field of the Invention

The present invention generally relates to a vibrating apparatus adapted to be connected with a well bore member and to be inserted into a well bore so that when it becomes necessary or desirable to vibrate the apparatus and the well bore member to which it is connected, such vibration can be accomplished by inserting a valve and diverting member into a through passageway in an eccentric rotor for causing flow through a bypass passageway in a manner to impart rotation to the eccentric rotor for vibrating the apparatus and well bore member to which it is attached.

2. Description of the Prior Art

Vibrating apparatuses for various purposes such as compaction and the like are well known and U.S. Pat. Nos. 3,410,528 and 3,784,168 disclose vibrating devices in the form of compactors for general purposes such as compacting concrete. Prior U.S. Pat. No. 3,162,426 discloses an eccentric rotor driven by a source of pressurized fluid which circulates through the device and returns to a source with the rotor being driven by a vane type fluid motor.

SUMMARY OF THE INVENTION

An object of the present invention is to provide a vibrating apparatus connected to a member insertable into a well bore, such as a fishing tool, section of well casing or the like, and which includes an eccentrically weighted rotor having a through passageway enabling flow of pressurized fluid therethrough while the rotor remains stationary and means rendered effective and ineffective from the ground surface to selectively cause flow through a bypass passageway which produces a rotational torque on the rotor for rotating the eccentrically weighted rotor and causing vibration of the apparatus and the member to which it is connected.

Another object of the invention is to provide a vibrating apparatus in accordance with the preceding object in which the means for selectively operating the eccentrically weighted rotor includes a plug insertable into the passageway at the ground surface and for movement down through the passageway into engagement with the through passageway in the rotor for closing the through passageway and diverting pressurized fluid through the bypass passageway.

A further object of the invention is to provide a vibrating apparatus in accordance with the preceding objects in which the plug is in the form of a spherical ball valve movable into engagement with the valve seat in the through passageway through the rotor by gravity and being subject to magnetic attraction so that a magnet may be lowered from ground surface to pick up the ball valve and remote it from the through passageway, thereby selectively causing fluid to pass through the bypass passageway or the through passageway.

Still another object of the invention is to provide a vibrating apparatus in which the means for diverting fluid flow from the through passageway to a bypass passageway is a plug insertable from ground surface and including a driving connection with the eccentrically weighted rotor, said plug extending into the through passageway and having a peripheral groove on the external surface defining by bypass passageway with the plug including a passageway communicating with the bypass passageway for imparting rotational torque to the rotor when the fluid is diverted through the bypass passageway.

Yet another important object of the present invention is to provide a vibrating apparatus in accordance with the preceding objects in which the rotatable eccentrically weighted rotor and associated components are constructed of drillable material whereby the vibrating apparatus is effective when running in well casing to enable the well casing to be more efficiently inserted into the well bore.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
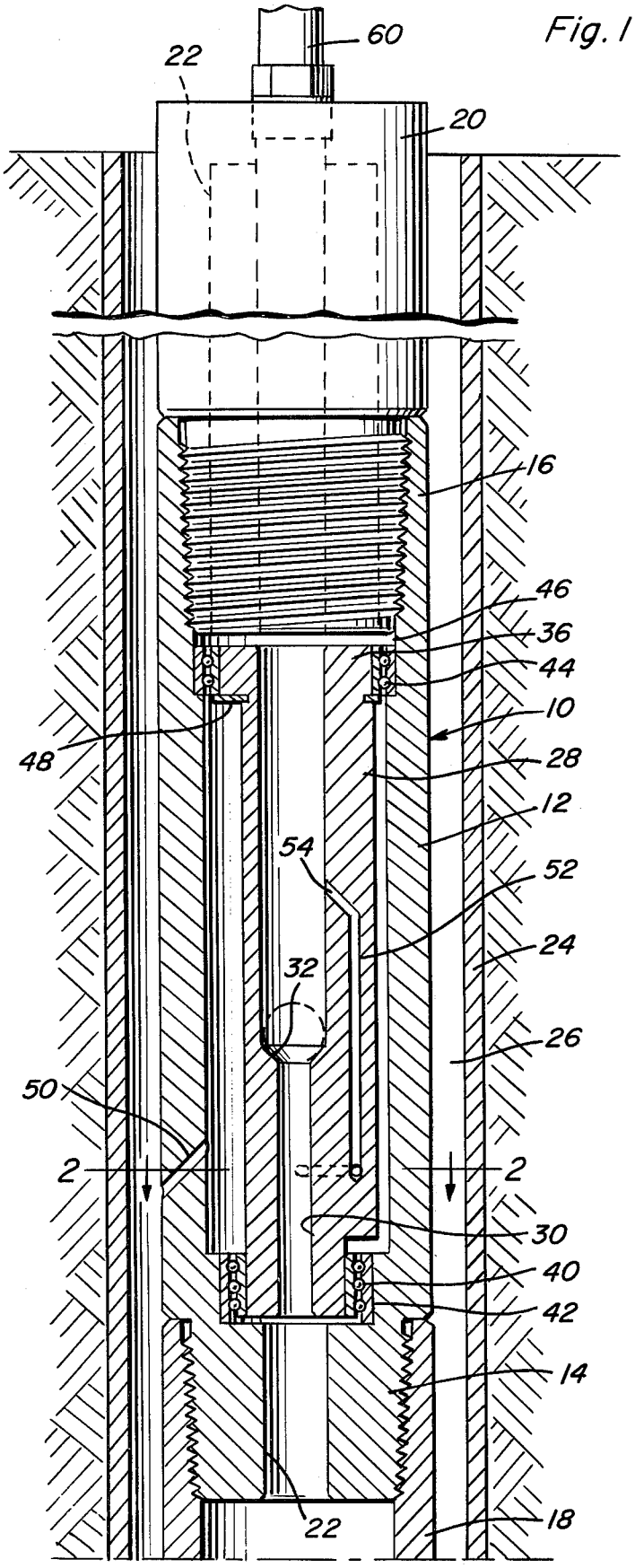
FIG. 1 is a vertical sectional view of the vibrating apparatus of the present invention illustrating the manner in which it is inserted into a well bore along with a member such as a fishing tool and the like with the structure of the through passageway and bypass passageway shown therein.
Figure 2:
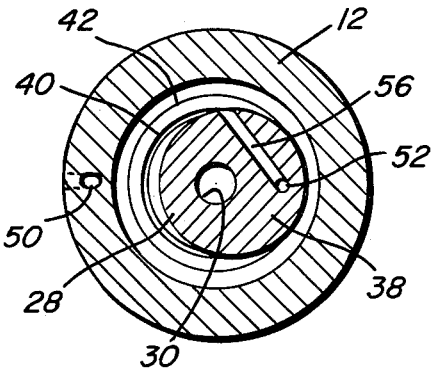
FIG. 2 is a transverse, sectional view taken substantially upon a plane passing along section line 2—2 of FIG. 1 illustrating the relationship of the through passageway and the angular, offset relation of the bypass passageway.
Figure 3:
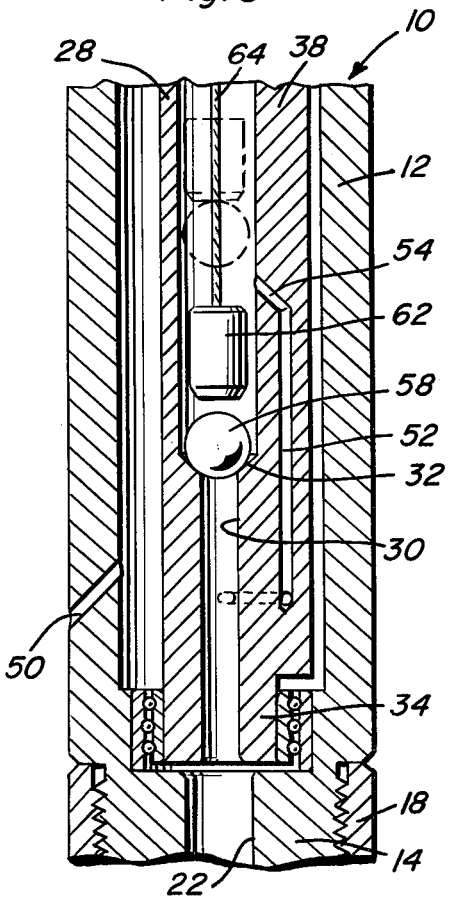
FIG. 3 is a fragmental sectional view illustrating the ball valve against the ball valve seat and a magnet for retrieving the ball valve when desired.

Referring now specifically to the drawings, the vibrating apparatus illustrated in FIGS. 1–3 is designated by numeral 10 and includes a generally cylindrical housing 12 having a reduced, tapering male or pin connecting 14 at the lower end and a tapered female or box connection 16 at the upper end. The length of the vibrating apparatus may vary and the lower end is adapted to be connected to various oil well members such as the upper end of a fishing tool 18 or the like. The use of the device is not restricted since it may be used with various tools or members insertable to a well bore. For example, if it becomes necessary to retrieve a broken drill string or the like, a fishing tool is inserted into the well bore and connected with the drill string or the like and frequently, it is desirable to vibrate the fishing tool in order to dislodge the drill string from the well bore in a well known manner. The upper end of the vibrating apparatus 10 is connected to a drill string 20 or other member inserted into the oil well such as a hollow casing or tube which extends to ground level and is connected to the usual mechanism for rotating, running in or breaking out such a drill string. The oil well member 18 and the drill string 20 includes a through passageway with the housing 12 also including a through passageway 22 communicated therewith for circulation of fluid through the drill string or other oil well member so that such fluid may also pass between the casing 24 and the oil well member 18 and housing 12 by virtue of passing through the annulus 26 in a well known manner.

Rotatably disposed in the housing 12 is an eccentrically weighted rotor 28 having a through passageway 30 therein with the upper portion of the passageway 30 being of larger diameter than the lower portion and separated therefrom by a valve seat 32. Also, the lower end of the rotor 28 is of reduced cylindrical configuration as indicated by numeral 34 and the upper end thereof is of cylindrical configuration 36 of slightly larger diameter with the cylindrical portions 34 and 36 defining a center of rotation concentric with the through passage 30 but with the major portion of the rotor 28 being offset as indicated by the offset or eccentric portion 38 of the rotor 28 in FIG. 2 so that when the rotor is rotated, the housing 12 which journals the rotor will be vibrated. As illustrated, the lower cylindrical end 34 of the rotor is journaled by bearings 40 received in a suitable shouldered recess 42 and the upper cylindrical end 36 is journaled by bearings 44 received in a similar shouldered recess 46 which has a split ring 48 or the like defining the lower end of the cylindrical portion 36 which arrangement enables the assembly of the rotor into the housing 12.

As illustrated, the external periphery of the rotor 28 is spaced from the interior of the housing 12 and the interior of the housing 12 is communicated with the annulus 26 through a passageway 50 adjacent the lower end of the housing 12 and which slants downwardly and outwardly as illustrated in FIG. 1. Also, the rotor 28 is provided with a bypass passageway 52 which includes an upper end portion 54 which extends from the upper portion of the through passageway 30 in a downwardly and outwardly direction with the upper portion 54 communicating with the major portion of the bypass passageway 52 which generally parallels the through passageway 30 in offset relation thereto as illustrated in FIGS. 1 and 2. The lower end of the bypass passageway 52, designated by numeral 56 extends in an angular direction to the periphery of the eccentric portion 38 of the rotor 28 as illustrated in FIG. 2 so that the discharge point of the bypass passageway is spaced laterally of the through passageway 30 and laterally of the rotational axis of the rotor 28 so that fluid under pressure exhausting from the bypass passageway 52 will impart rotational torque to the rotor 28 in order to cause the rotor to rotate about its rotational axis with the eccentric weight 38 thereof causing vibration of the housing 12 and the complete vibrating apparatus and also vibration of the well bore member 18 to which it is attached.

Normally, fluid pressure flowing through the through passageway 22 will pass directly through the through passageway 30 without interference and under these circumstances, the rotor 28 remains stationary. When it is desired to vibrate the well bore member 18 such as a fishing tool, the through passageway 30 may be closed by a spherical ball valve 58 which is dropped into the through passageway 22 extending to ground level so that it will descend by gravity into engagement with the valve seat 32 thus closing the through passageway 30. When this occurs, pressurized fluid entering the through passageway 22 at the upper end of the drill string through a suitable piping arrangement 60 will be bypassed through the bypass passageway 52 thus causing rotation of the rotor 28 and vibration of the vibrating apparatus 10 along with the well bore member 18 to which it is connected. When the vibrating apparatus has accomplished its function and it is no longer necessary to cause vibration, the spherical ball valve 58 may be removed by use of a suitable implement such as a magnet 62 which can be lowered into the through passageway 22 by a flexible wire line 64 or the like. The magnet 62 may be in the form of a permanent or electromagnet with the ball valve 58 being constructed of ferrous material or provided with a ferrous insert whereby it is attracted by the magnet 62 so that the ball valve 58 may be retrieved from the through passageway thus again opening the through passageway for passage of pressurized fluid. The fluid which is discharged through the bypass passageway 52 and discharged generally tangentially in relation to the through passageway 30 in the rotor 28 will be discharged through the passageway 50 into relatively low pressure annulus 26 with variation in pressure and fluids involved enabling variation in the rotational speed and vibrating frequency of the vibrating apparatus.

Figure 4:
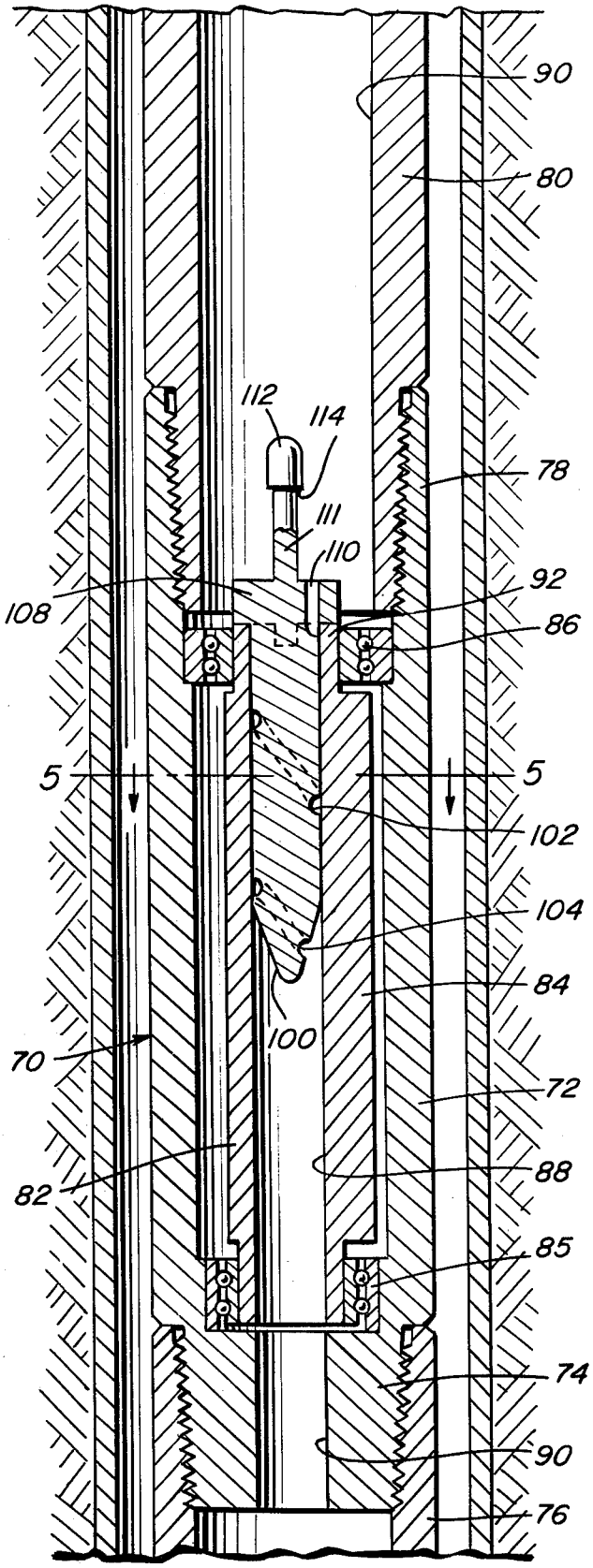
FIG. 4 is a fragmental, vertical sectional view of another embodiment of the invention in which an insertable plug is provided with a bypass passageway on the exterior thereof with the plug coacting with the through passageway to define the bypass passageway.
Figure 5:
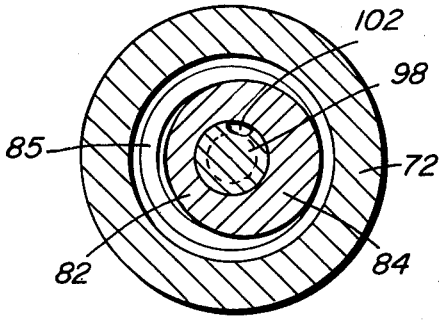
FIG. 5 is a transverse, sectional view taken substantially upon a plane passing along section line 5—5 of FIG. 4 illustrating the structural details of the eccentrically weighted rotor and the plug therein.
Figure 6:
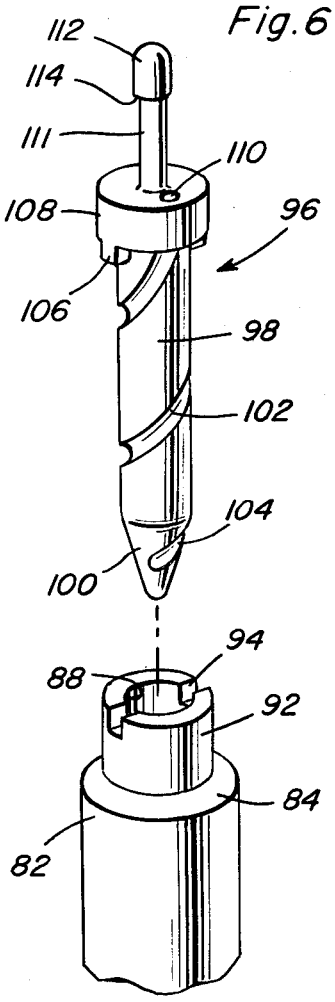
FIG. 6 is an exploded group perspective view of the rotor and plug illustrating the driving connecting therebetween.

FIGS. 4–6 illustrate another embodiment of the vibrating apparatus generally designated by numeral 70 and which includes a cylindrical housing 72 having a lower threaded connection 74 with an oil well bore member 76 and an upper female threaded connection 78 engaged with a drill string or oil well bore member 80 in the same general orientation as the device illustrated in FIGS. 1–3. The vibrating apparatus 70 includes a rotor 82 journaled in bearing assemblies 84 and 86 at the lower and top ends thereof respectively in generally the same manner as that illustrated in FIG. 1. The rotor 82 includes an eccentric portion 84 defining an eccentric weight so that when the rotor rotates, it will cause vibration of the vibrating apparatus and the oil well members to which it is connected. The rotor also includes a through passageway 88 of substantially constant cross-sectional dimension which communicates with a through passageway 90 through the lower end of the casing 72 and also through the oil well members 76 and 80. The upper end of the rotor 82 includes a reduced cylindrical end 92 which projects above the upper bearing assembly 86 as illustrated in FIG. 4 and includes a pair of diametrically opposed notches or recesses 94 in the upper end edge thereof as illustrated in FIG. 6.

A plug generally designated by numeral 96 is inserted into the rotor 82 when it is desired to cause rotor 82 to rotate. The plug 96 includes an elongated cylindrical member 98 closely fitting into the through passageway 88 in the rotor 82 as illustrated in FIG. 4. The lower end of the member 98 is tapered slightly as indicated by numeral 100 to facilitate insertion of the cylindrical member 98 into the through passageway 88. The periphery of the cylindrical member 98 is provided with a spiral groove 102 which, when the cylindrical member 98 is inserted into the through passageway 88 defines a bypass passageway having a lower discharge end 104 that is laterally offset and generally tangential in relation to the center of the through passageway 88 and the rotational axis of the rotor 82 which coincides with the center of the through passageway 88. Thus, as pressurized fluid passes down through the bypass passageway defined by the groove 102 and the interior of the through passageway 88, the discharge of such fluid from the discharge end 104 of the bypass passageway will cause the plug 96 to rotate. However, the plug 96 is locked to the rotor 82 by virtue of a pair of depending lugs 106 formed on the lower end of a cylindrical upper end 108 on the plug 96 with the cylindrical upper end 108 being generally the same diameter as the cylindrical extension 92 on the rotor 92 so that when the plug 96 is installed, the cylindrical extension 98 will telescope into the through passageway 88 and the projecting lugs 106 will engage with the notches 94 for driving connection between the plug 96 and the rotor 82. The cylindrical member 108 is provided with a passageway 110 therein which is in alignment with the upper end of the spiral groove 102 to provide an inlet for fluid under pressure when the plug 96 is in seated engagement and driving engagement with the rotor 82 as illustrated in FIG. 4. If, when the plug is installed, the lugs 106 are not aligned with the notches 94, fluid under pressure may still pass downwardly through the groove 102 causing the plug 96 to rotate in relation to the rotor until the lugs 106 align with the notches 94 at which time they will drop into the notches 94 and thereafter drive the rotor 82.

The upper end of the plug 96 is provided with an extending neck 112 of relatively small diameter provided with a rounded head 112 of larger diameter on the upper end thereof thus forming a downwardly facing shoulder 114. This construction provides for retrieval of the plug by dropping a suitable grapple-type device or connector down through the through passageway 90 until it comes into contact with and drops onto the head 112 with the connector engaging the downwardly facing shoulder 114 so that the plug may be removed from the rotor. The plug 96 may be lowered by gravity either with a suitable connector or grapple device and a wire line or may be merely dropped into the passageway 90 with the downward force exerted by fluid under pressure being adequate to control the descent of the plug 96.

In this arrangement, when the plug is installed into the position of FIG. 4, fluid under pressure passing down through the through passageway 90 will be blocked by the cylindrical upper end 108 and thus caused to bypass through the bypass passageway 102 and subsequently be discharged at the lower end thereof as at 104 with this fluid then passing on down through the through passageway 88. However, due to the offset of the passageway 102 and the discharge end 104 thereof in relation to the rotational axis and the general tangential relationship thereof, the reaction of such discharge will cause rotational torque to be imparted to the plug 96 which by virtue of its driving connection through the lugs 106 and notches 94 will impart the rotational torque to the rotor 82 whereby such rotational torque will cause the rotor 82 to rotate at a desired speed for imparting vibration to the vibrating apparatus 70 and the oil well members 76 and 80 to which it is attached.

Figure 7:
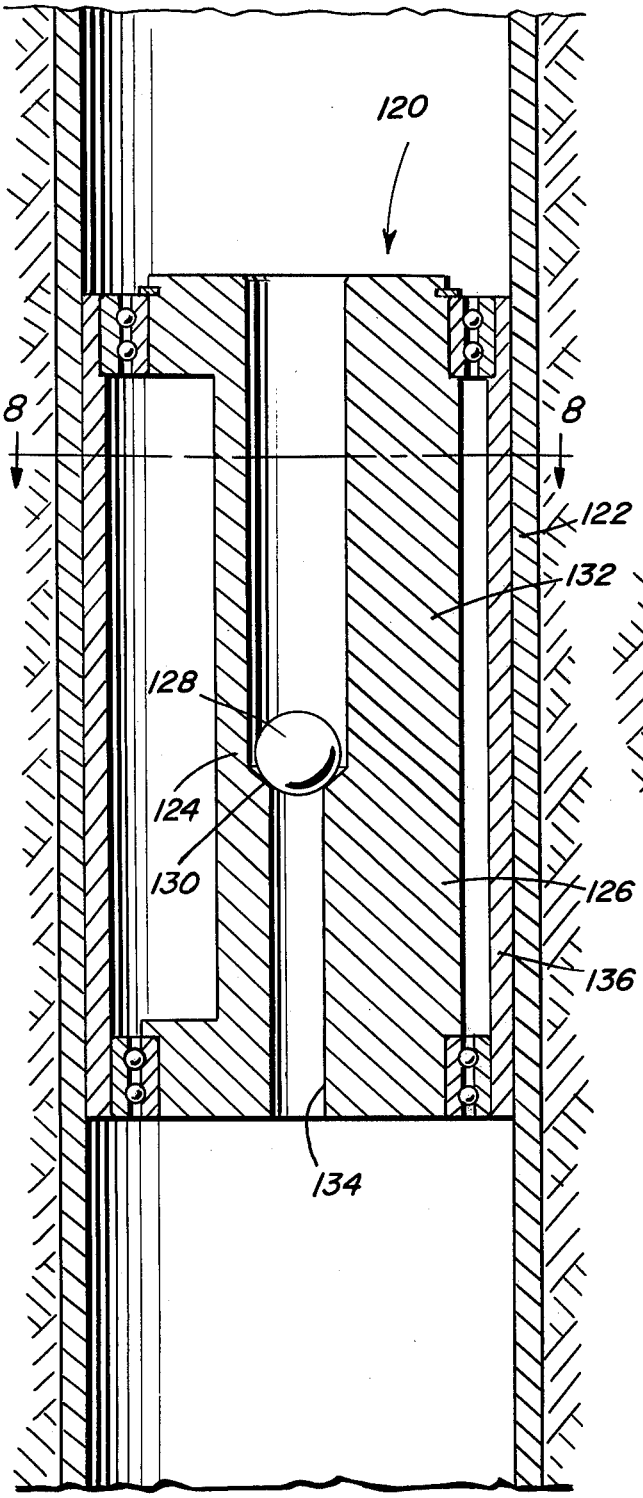
FIG. 7 is a sectional view illustrating the vibrating apparatus of the present invention installed in a section of well casing which may be used to facilitate the running in of the well casing in a well bore.
Figure 8:
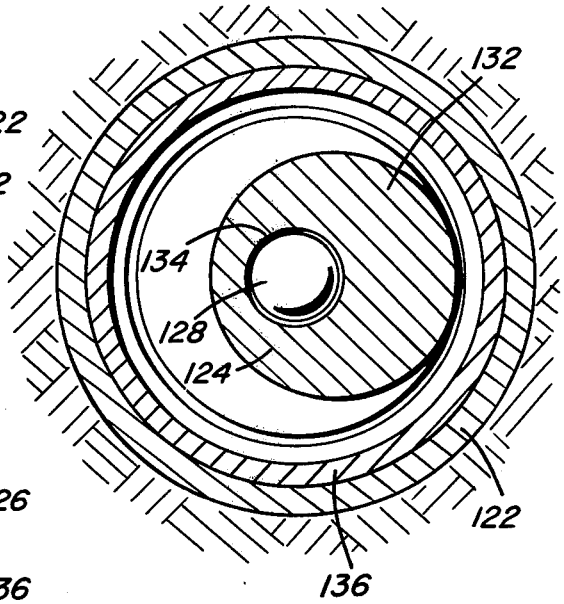
FIG. 8 is a transverse, sectional view taken substantially upon a plane passing along section line 8—8 of FIG. 7 illustrating further structural details of this embodiment of the invention.

FIGS. 7 and 8 illustrate an embodiment of the invention in which the vibrating apparatus is generally designated by numeral 120 and is installed in the interior of a short joint of well casing of the same type and size of casing being run into the well bore. The specific construction of the vibrating apparatus may be substantially the same as that illustrated in FIGS. 1–3 or FIGS. 4–6 with the embodiment of FIGS. 1–3 being illustrated in FIGS. 7 and 8 in which the rotor 124 provided with the eccentric mass or weight 126 is rotated when the ball valve 128 is positioned on the valve seat 130 and fluid pressure flow is directed through the bypass line 132 rather than through the through passageway 134. The short joint of casing 122 is threadedly connected to the remainder of the casing being run into the well bore in a conventional manner. This vibrating apparatus is primarily used to free the well casing if it becomes stuck in the well bore before reaching the proper depth in the hole. The vibrating apparatus also will create a better cement bond to the outside of the casing which sometimes has a tendency to "channel out" through the mud on the outside of the pipe while being pumped in place thus causing the casing to be cemented on one side only. The vibrating apparatus will prevent this problem and once the casing is in place and the cementing operation completed, the drillable eccentric rotor and its housing may be drilled out and the short joint of casing 122 becomes part of the casing string. The housing 136 may be bonded to or otherwise secured to the interior of the short joint of casing 122.

In each embodiment of the invention, the vibrating apparatus is normally rendered ineffective and fluid circulation is accomplished in the usual manner. However, when the application of vibratory movement, oscillation or the like to the member inserted into the well, the plug for the through passageway is placed into the upper end of the tubular string thus closing off the through passageway and causing the pressurized fluid to flow through the bypass passageway thus causing rotary torque to be exerted on the rotor thus causing the rotor to rotate which, due to the eccentric weight of the rotor, causes the apparatus to vibrate.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a member inserted into a well bore, a vibrating apparatus connectable to said member to impart lateral vibratory movement thereto for loosening the member in the well bore, said vibratory apparatus comprising a housing having means at the lower end for connection to the member and means at the upper end for connection with a source of pressurized fluid, said housing having a hollow interior communicating with the ends of the housing, an eccentric rotor rotatably journaled in said housing and having a center of mass offset from the axis of rotation, said rotor including a passageway extending therethrough for communication with the upper and lower ends of the housing, said passageway being coincident with the rotational axis of the rotor whereby passage of fluid therethrough will not rotate the rotor, means associated with said passageway to selectively prevent downward fluid flow therethrough and bypass passageway means providing communication past said means when the means is closed, said bypass passageway means including reaction means through which pressurized fluid passes to impart rotary movement to the eccentric rotor and cause the housing and member to vibrate when pressurized fluid flows downwardly through the bypass passageway means and is discharged from the housing into a low pressure zone in the well bore.

2. The structure as defined in claim 1 wherein said bypass passageway means includes a bypass duct in said rotor having an upper end communicating with the fluid supply and an angular disposed lower end offset from the rotational axis and defining said reaction means to impart torque to the rotor when fluid is discharged therefrom.

3. The structure as defined in claim 2 wherein said means includes a valve seat in said passageway and a ball valve engageable with said seat to form a closure for the passageway.

4. The structure as defined in claim 3 wherein said ball valve is constructed of material subject to magnetic attraction, and a magnet lowerable into the passageway for picking up and removing the ball valve thereby enabling selective closing of the passageway and selective bypassing of fluid under pressure through the bypass passageway means.

5. The structure as defined in claim 4 wherein said housing includes a passageway communicating the interior thereof with the annular passage between a well casing and a member inserted therein thereby enabling discharge of fluid from the interior of the housing for the vibrating apparatus to a reduced pressure zone in the well bore externally of the member inserted into the well bore.

6. The structure as defined in claim 1 wherein said means associated with the passageway to selectively prevent downward fluid flow therethrough includes a plug engaging the upper end of the rotor, said plug including a depending member inserted into the through passageway in close fitting relation thereto, said depending portion including a spiral groove in the pperiphery thereof to define said bypass passageway means, said plug having a passageway in the upper end thereof in communication with the spiral groove for enabling flow of fluid under pressure into the spiral groove, and a driving connection between the plug and rotor in order to rotate the rotor during passage of fluid under pressure through the bypass passageway means and discharged therefrom in offset relation to the rotational axis of the rotor.

7. The structure as defined in claim 6 wherein said plug includes an axially upstanding neck having a head thereon for engagement by a tool for enabling removal of the plug for selectively closing the through passageway and causing flow of fluid through the bypass passageway means.

8. The structure as defined in claim 7 wherein said head is provided with a rounded upper end for engagement with the tool and a downwardly facing shoulder to provide a gripping area for a tool for removing the plug from the rotor.

9. The structure as defined in claim 1 wherein said housing is rigidly secured to a short section of casing in order to vibrate the casing when it is being run into a well bore, said housing and rotor being constructed of drillable material to enable the vibrating apparatus to be drilled out of the casing after the casing has been run in and cemented in place.

10. In combination, a well bore having a tubular member therein normally receiving a flow of fluid under pressure and subjected to being undesirably jammed in the well bore, a vibrating apparatus connected to said member and forming a portion of the fluid flow path whereby fluid flow through the member in the well may be maintained, said vibrating apparatus including a housing connected into the tubular member, an eccentric rotor mounted in the housing and including a through passage for flow of fluid under pressure with the through passage being concentric with the rotational axis of the rotor whereby flow through the rotor will not cause rotation thereof, and bypass passageway means associated with the rotor and being in communication with the through passage through the rotor, means for selectively causing fluid flow under pressure through the bypass passageway means, said bypass passageway means including a discharge disposed laterally of and in angular relation to the rotational axis of the rotor whereby discharge of fluid under pressure from the bypass passageway means will exert rotational torque on the rotor for causing rotation of the rotor and vibration of the housing and member to which it is connected thereby loosening the member in the event of an undesirable jam of the member within the well.

11. The combination as defined in claim 10 wherein said means includes a plug valve means inserted into the tubular member for engagement with the through passageway in the rotor, said valve means including means to enable retrieval and removal of the valve means thereby enabling selective rotation of the rotor and flow of fluid through the through passage with the rotor remaining stationary, said valve means being insertable into the tubular member from ground surface and being retrieval from ground surface thereby enabling selective actuation of the vibrating apparatus.

* * * * *